US007651363B2

(12) United States Patent
Koellmann

(10) Patent No.: US 7,651,363 B2
(45) Date of Patent: Jan. 26, 2010

(54) TERMINAL COMPONENT

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/113,333

(22) Filed: May 1, 2008

(65) Prior Publication Data

US 2008/0280508 A1 Nov. 13, 2008

(30) Foreign Application Priority Data

May 11, 2007 (DE) ..... 10 2007 022 806

(51) Int. Cl.
*H01R 4/24* (2006.01)

(52) U.S. Cl. ..... 439/441; 439/834

(58) Field of Classification Search ..... 439/436, 439/437, 440, 441, 828, 834, 835, 836
See application file for complete search history.

(56) References Cited

U.S. PATENT DOCUMENTS

| | | | | |
|---|---|---|---|---|
| 5,679,021 | A * | 10/1997 | Kramer | 439/835 |
| 6,786,779 | B2 * | 9/2004 | Feldmeier et al. | 439/729 |
| 7,083,463 | B2 * | 8/2006 | Steinkemper et al. | 439/441 |
| 7,204,727 | B2 * | 4/2007 | Germani | 439/835 |
| 7,252,534 | B2 * | 8/2007 | Reibke | 439/404 |

FOREIGN PATENT DOCUMENTS

| | | | |
|---|---|---|---|
| DE | 3019149 | A1 | 11/1981 |
| DE | 3514099 | A1 | 10/1986 |
| DE | 3514097 | A1 | 10/1996 |
| DE | 19626390 | A1 | 1/1997 |
| DE | 19654611 | | 6/1998 |
| DE | 19711051 | | 9/1998 |
| DE | 202006 017 144 | U1 | 1/2007 |
| EP | 0924799 | | 6/1999 |

* cited by examiner

*Primary Examiner*—Thanh-Tam T Le
(74) *Attorney, Agent, or Firm*—Whitham Curtis Christofferson & Cook, P.C.

(57) ABSTRACT

The invention describes a terminal component (1) with an insulating housing (2) and at least one spring-force clamping connection (3), which has a bent clamping spring (4), formed from sheet spring steel, with bearing limbs (8) and clamping limbs (7), which are connected to one another via a spring bow (6), a busbar (5), which is inserted into the clamping limb (7) and bears against the bearing limb (8), and a conductor insertion channel (9), which is formed in the insulating housing (2) and extends from the rear spring bow (6) of the clamping spring (4) along the bearing limb (8) at least as far as the busbar (5). The wall, which is formed from the insulating housing (2), of the conductor insertion channel (9) is partially interrupted. That end of the busbar (5) which bears against the bearing limb (8) runs obliquely with respect to the bearing limb (8) and forms a funnel of the conductor insertion channel (9). The bearing limb (8) of the clamping spring (4) forms, in the interrupted part of the insulating housing (2), together with the busbar (5), a wall of the conductor insertion channel (9).

14 Claims, 4 Drawing Sheets

TERMINAL COMPONENT

FIELD OF THE INVENTION

The invention relates to a terminal component with an insulating housing and at least one spring-force clamping connection, which has a bent clamping spring, formed from sheet spring steel, with bearing limbs and clamping limbs, which are connected to one another via a spring bow, a busbar, which is inserted into the clamping limb and bears against the bearing limb, and a conductor insertion channel, which is formed in the insulating housing and extends from the rear spring bow of the clamping spring along the bearing limb at least as far as the busbar.

BACKGROUND OF THE INVENTION

Such clamping components are known as connecting terminals for electrical conductors from DE 197 11 051 A1. The conductors are inserted into the conductor insertion channel via the spring bow through an aperture in the clamping limb into an area of the conductor insertion channel beneath the clamping spring. In this case, the conductor insertion channel is formed by a turn in the insulating housing which forms a funnel. In this case, a wall part adjoins the bearing limb of the clamping spring and merges virtually seamlessly with that end of the busbar which extends through the clamping limb.

DE 30 19 149 C2 has disclosed a screwless connection terminal, in which the end of an obliquely positioned bearing limb of a bent clamping spring rests with spring force on a conductor end, which is plugged through a conductor insertion channel into a free cavity.

Another embodiment of a connection terminal for electrical conductors is described in DE 35 14 097 C2 and DE 35 14 099 C2. Here too, a conductor end is first pushed through a conductor insertion channel, which reaches as far as the spring bow of a bent clamping spring, in order then to come into electrical contact with a bearing limb of the clamping spring which bears in sprung fashion. A further conductor pushed in from the side is plugged with its conductor end through a passage opening of a clamping limb of the clamping spring and, as a result of the spring force of the clamping limb, which spring force counteracts the spring force with respect to the bearing limb, is brought into contact at the end of the first conductor. In one embodiment, a busbar piece is arranged between the two conductor ends, which point in the opposite direction to one another.

DE 106 90 54 611 B4 has disclosed a spring-force clamping connection for electrical conductors, in which, in a similar way to in DE 30 19 149 C2, an electrical conductor is pushed with its conductor end through a conductor insertion channel and is pressed against a downwardly bent bearing limb of the clamping spring. The bearing limb is hereby displaced and bears against the conductor end which is pushed in beyond the clamping spring. The clamping spring is inserted into a bent busbar, with the result that the conductor end is pressed by the bearing limb against a contact limb of the busbar in order to ensure contact between the conductor and the busbar piece.

As a result of the positioning of the conductor insertion channel, known, for example, from DE 197 11 051 A1, with a substantial part of its length beneath the bearing limb of the clamping spring, a reduction in the physical height of the terminal component in the direction of extent of the conductor insertion channel has already been achieved.

SUMMARY OF THE INVENTION

Against this background, the object of the present invention is to further reduce the width of clamping components in the direction of the spring excursion of the clamping spring.

The object is achieved with the clamping component of the type mentioned at the outset by virtue of the fact that that end of the busbar which bears against the bearing limb runs obliquely with respect to the bearing limb and forms a funnel of the conductor insertion channel, and that the bearing limb of the clamping spring forms, in the interrupted part, together with the busbar, a wall of the conductor insertion channel.

As a result of the removal of the wall, which is provided in the electrical terminal in accordance with DE 197 11 051 A1, of the conductor insertion channel formed from the insulating housing in the region adjacent to the bearing limb of the clamping spring, it is possible to reduce the physical width of clamping components. However, this is only possible by virtue of the fact that the bearing limb of the clamping spring itself forms a wall of the conductor insertion channel, along which the conductor end is guided. The necessary funnel guidance and stability is ensured by that end of a busbar which runs obliquely with respect to the bearing limb, which busbar, together with the bearing limb, replaces the insulating wall provided in the mentioned prior art of the conductor insertion channel.

In contrast to other variants of connecting terminals in which the bearing limb of a clamping spring is positioned obliquely in the conductor insertion region and obstructs it, with the result that, behind the conductor insertion channel which already ends at the spring bow of the clamping spring, there is no longer a guidance channel for the electrical conductor provided, such a guidance channel, which until now has been missing, for the conductor end is provided by the busbar, which runs obliquely with respect to the bearing limb and bears against the bearing limb, the bearing limb and the oblique position of the busbar with respect to the bearing limb, without this resulting in an enlargement of the physical width of the clamping components.

It is particularly advantageous if that end of the busbar which bears against the bearing limb is plugged through an opening in the bearing limb. In this way, a cross joint between the bearing limb and the busbar is prevented and the conductor end is prevented from interlocking when it is inserted into the conductor insertion channel. In one embodiment of the clamping component, those ends of the bearing limb and the clamping limb of the clamping spring which adjoin the spring bow can be spaced apart from one another, as is already known per se from DE 197 11 051 A1.

It is particularly expedient if the clamping limb has a first section, which adjoins the spring bow and extends substantially in the direction parallel to the conductor insertion channel, and a second section, which extends substantially transversely with respect to the direction of the conductor insertion channel. In the second section of the clamping limb, a window cutout is provided into which that end of the busbar which bears against the bearing limb is plugged. This makes it possible to exert a high spring force on the conductor end which has been plugged through the window cutout given a small contact area and therefore to ensure optimum electrical contact.

In order to improve the electrical contact between the conductor end and the busbar, it is advantageous if the busbar which extends substantially in the conductor plug-in direction of the conductor insertion channel has a hump in the region of the clamping limb. This hump firstly serves the purpose of providing a slope for the funnel entry point of the conductor insertion channel and secondly acts as deflection point for the conductor end bearing against it in order to thereby fix the electrical conductor and to prevent unintentional withdrawal of the conductor from the clamping component.

It is particularly advantageous if the busbar has, beneath the clamping limb of the clamping spring, an integrally formed connecting plate, which protrudes from a side edge of the busbar at right angles, and a connection rail, which adjoins the connecting plate at right angles and is designed to be at least partially mirror-symmetrical with respect to the busbar. In this way, a cage for accommodating the conductor end which has been plugged through the clamping limb is provided beneath the clamping limb of the clamping spring. In addition, the stability of the busbar is improved.

In one embodiment, the free ends of the busbar and the connection rail can be inclined so as to point toward one another and can have connection contact faces preferably at their free ends in order thereby to form a connection socket for a connection plug or the like. This connection socket makes it possible, for example, to position the terminal component onto connection pins which protrude, for example, out of a printed circuit board.

In one embodiment, for example, the connecting plate can have a connection plate, which protrudes at right angles at that end of the connecting plate which is opposite the clamping limb from the connecting plate and extends transversely with respect to the direction of the conductor insertion channel. In this way, the busbar, the connecting plate, the stop plate and the connection rail form a cage for accommodating a conductor end.

In order to insert the electrical conductor into the clamping point of the terminal component, it is expedient and often necessary for the clamping point to be opened in advance. This can take place in a variety of ways, for example by means of a tool or a push element, which is moved approximately with a vertical alignment with respect to the clamping limb of the clamping spring and presses the latter against the bearing limb of the clamping spring. In order to actuate it, a screwdriver or a plunger slide can also be inserted axially into a terminal actuating opening or a terminal actuation channel of the insulating housing and pushed forward against the clamping limb of the clamping spring to such an extent that the latter is displaced substantially transversely with respect to the advancing direction of the actuating tool and thereby implements a pivoting movement about the mid-axis of the rear spring bow of the clamping spring. For this purpose, it is advantageous that the insulating housing has, adjacent to the spring bow opposite the conductor insertion opening, an actuating opening, which is formed at least partially in the side wall of the insulating housing, for inserting a screwdriver and pivoting the clamping limb with the inserted screwdriver. This actuating opening preferably extends at an angle in the range of from 5-30° and preferably approximately 20° with respect to the direction of the conductor insertion opening. In this way, the physical width transversely with respect to the conductor insertion direction can be further reduced since, as a result of the oblique position, the side wall of the terminal component transversely with respect to the upper side is used along with the opening of the conductor insertion channel for the actuating opening.

The actuating opening preferably ends beneath the passage of the busbar through the clamping limb directly at the busbar. This has the advantage that the area beneath the clamping limb can also be used for the actuation of the clamping spring.

The clamping limb preferably has, at its free end adjacent to a window cutout, through which the free end, which bears against the bearing limb, of the busbar is plugged, an end piece, which closes the window cutout. This end piece firstly serves the purpose of pressing the conductor end against the end of the busbar and hereby ensuring an electrical contact. As a result of the narrow design of the end piece, a further reduction in the physical width can be achieved.

In a terminal component, one or more clamping points of the above-described type can be provided. In this case, for example, in each case at least two spring-force clamping connections can be connected to one another via a common busbar. In a manner known per se, an overcurrent fuse, a switch or the like can be integrated in the busbar.

It is likewise conceivable for the terminal component to contain electronics, which are integrated in the insulating housing and are connected to at least one spring clamping connection of the above-described type via a respective busbar.

The clamping components described can be in the form of an outlet box terminal, connecting terminal, terminal strip for plugging onto a top-hat rail, an isolating terminal, a fuse terminal, a feed-through terminal or a printed circuit board terminal etc. The clamping component can also be an electronic component, such as an I/O module, measured value converter or the like for automation purposes, for example, which can be plugged onto a top-hat rail, for example, and in which the spring clamping connections are used for connecting sensors, actuators etc.

DESCRIPTION OF THE DRAWINGS

The invention will be explained by way of example in more detail below with reference to the attached drawings, in which.

DETAILED DESCRIPTION

Figure 1:
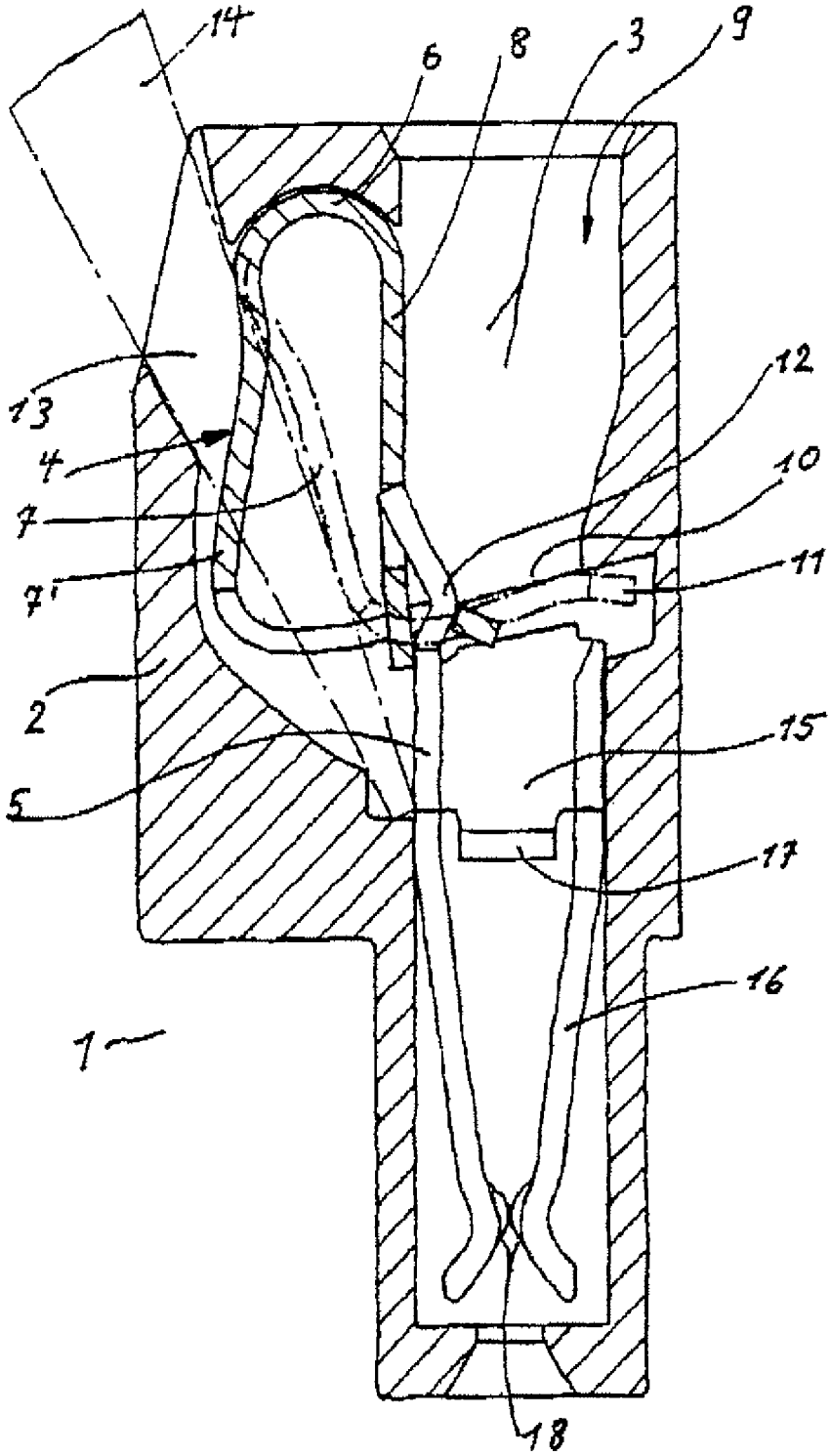
FIG. 1 shows a cross-sectional view through a first embodiment of a terminal component.

FIG. 1 shows a terminal component 1 as a detail and in cross section. The terminal component 1 has an insulating housing 2, which is formed in a manner known per se from an electrically insulating material, in particular plastic material. At least one spring clamping connection 3 is arranged in the insulating housing 2 and is formed from a clamping spring 4 and a busbar 5. The clamping spring 4 is formed from sheet spring steel and has a spring bow 6, whose first end is adjoined by a clamping limb 7 and whose second end is adjoined by a bearing limb 8. The clamping limb 7 is bent approximately at right angles and has, in its section 10 extending substantially transversely with respect to the direction of a conductor insertion channel 9, a window cutout, through which one end of the busbar 5 is plugged. That end of the busbar 5 which is plugged through the window cutout is bent in the direction of the bearing limb 8 and plugged into an opening in the bearing limb 8. It can be seen that no wall of the insulating housing 2 is provided in the region of the bearing limb 8 of the conductor insertion channel 9, which is provided for the purpose of inserting one end of an electrical conductor into the spring clamping connection 3 and through the window cutout. In contrast, the insulating housing 2 forms, in the further region of the conductor insertion channel 9 adjacent to the bearing limb 8 as far as the region of the second section 10 of the clamping limb 7, a conductor insertion channel 9 which is configured in the form of a funnel in the lower region. It can be seen that the bearing limb 8 together with the upper end of the busbar piece 5, which merges seamlessly with the bearing limb 8 as a result of the oblique position, forms a wall, which is likewise in the form of a funnel in the lower region, of the conductor insertion channel 9. In order to plug a conductor end in and make contact with it, the clamping limb 7, as illustrated, is displaced in the direction of the busbar 5, with the result that the conductor end can be plugged through the window cutout. Then, the clamping spring 4 is released again, so that the clamping limb 7' is pivoted back into the position illustrated by dashed lines and in the process presses the conductor end in the region of the window cutout through an end piece 11 at the free end of the second section 10 of the clamping limb 7' against the busbar 5. As a result of a spring force and a small contact area, optimum electrical contact is ensured.

It can be seen that that end of the busbar 5 which is plugged through the window cutout is bent in the region of the window cutout in such a way that the busbar 5 has a hump 12 in the region of the clamping limb 7, from which hump the end of the busbar 5 extends obliquely in the direction of the bearing limb 8.

This hump 12 also ensures a firm fit of the conductor in the spring clamping connection 3 by virtue of the conductor end being bent back slightly by the hump 12. This makes withdrawal of the conductor upward substantially more difficult without actuation of the clamping spring 4.

In order to actuate the spring-force clamping connection 3, an actuating opening 13 is provided into which, for example, a screwdriver can be plugged. The actuating opening 13 extends at an angle preferably in a range of from 5 to 30°, particularly preferably, as illustrated, at an angle of approximately 20° in the direction toward the plug-in direction of the conductor insertion opening 9.

It can be seen that the actuating opening 13 is not formed exclusively in the upper region of the terminal component 1 but partially in the side wall by virtue of part of the side wall of the insulating housing 2 being removed in order to form the actuating opening 13. In this way, the physical width transversely with respect to the plug-in direction of the conductor insertion channel 9 is reduced.

In the exemplary embodiment illustrated, the busbar 5 forms a cage by virtue of the fact that a connecting plate 15 protrudes at right angles from a side edge of that part of the busbar 5 which is plugged through the window cutout of the clamping limb 7. This connecting plate 15, likewise at right angles, is adjoined by a connection rail 16, which is formed at least partially so as to be mirror-symmetrical with respect to the busbar 5. The busbar 5, the connecting plate 15 and the connection rail 16 are preferably integrally formed by reshaping machining.

In the lower region of the connecting plate 15 between the busbar 5 and the connection rail 16, a stop plate 17 is provided which extends transversely with respect to the direction of the conductor insertion channel. The busbar 5 in this way forms, together with the connecting plate 15, the connection rail 16 and the stop plate 17, a cage for accommodating a conductor end.

At the free end of the busbar 5 and the connection rail 16, connection contact faces 18 are provided which, together, can act as a connection socket for making contact with, for example, a further conductor end, a connection pin which is soldered onto a printed circuit board, for example, or the like.

Figure 2:
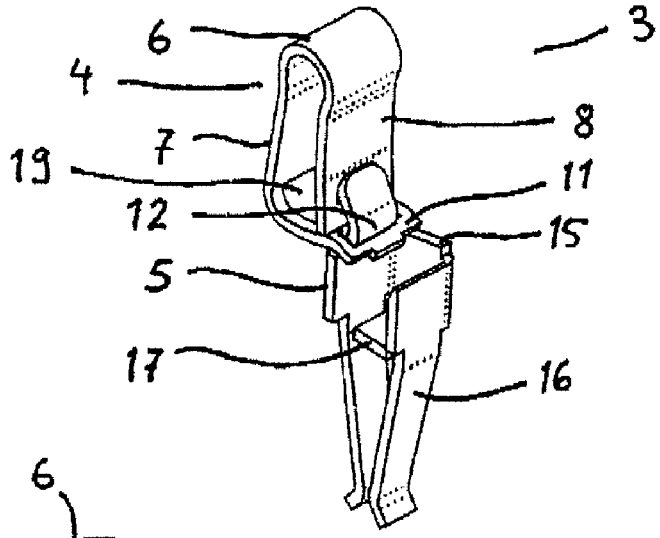
FIG. 2 shows a perspective view of a clamping spring with the busbar piece plugged in without the insulating housing.

FIG. 2 shows a perspective view of the spring clamping connection 3 from FIG. 1 with the bent clamping spring 4 and the busbar piece 5. It is shown that a window cutout 19 is provided in the second, bent-back section of the clamping limb 7, through which window cutout the free end of the busbar 5 is plugged and from there runs obliquely in the direction of the bearing limb 8. In this way, the bearing limb 8 and the oblique end of the busbar 5 form a region of the conductor insertion channel which is in the form of a funnel at the end.

Likewise shown is the cage, which is provided beneath the bent-back second section of the clamping limb 7 and is formed from the busbar 5, the opposite connection rail 16, the connecting plate 15, which integrally connects the busbar 5 and the connection rail 16, and the stop plate 17 on the connecting plate 15.

It can furthermore be seen that a further connection contact with the busbar 5 is formed beneath the cage by the free ends of the busbar 5 and the opposite connection rail 16.

Figure 3:
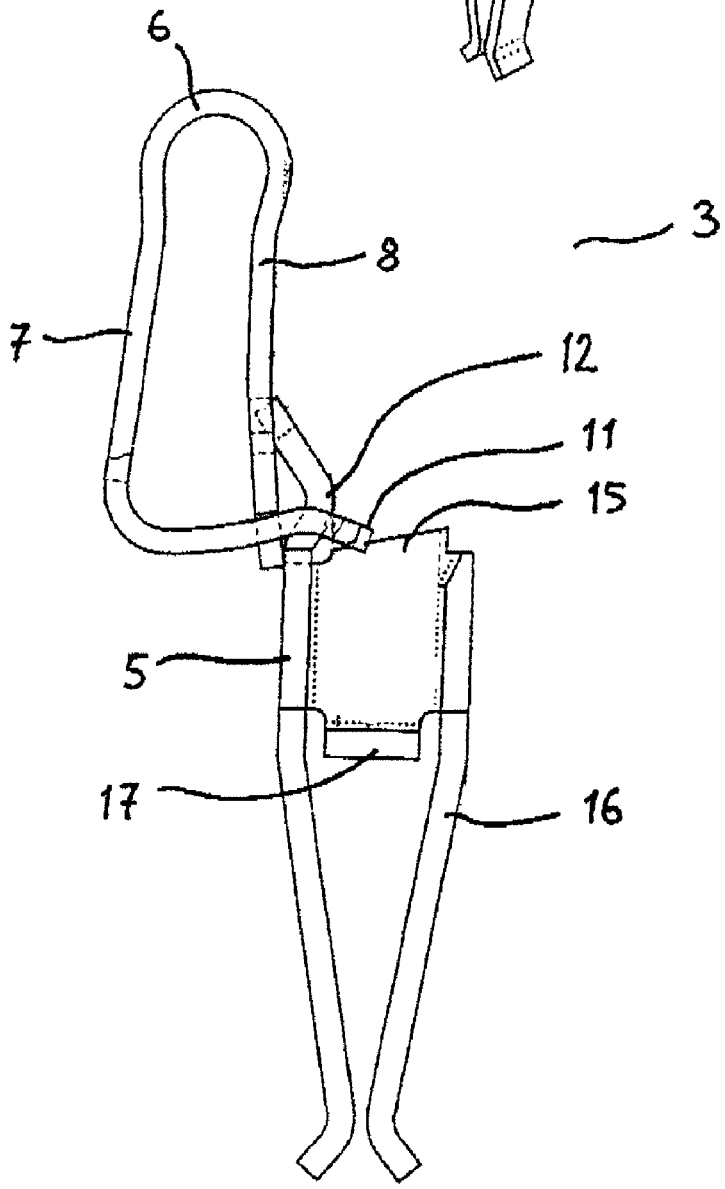
FIG. 3 shows a side view of the clamping spring with the busbar piece plugged in without the insulating housing.

FIG. 3 shows the spring clamping connection 3 from FIGS. 1 and 2 once again in a side view. The hump 12 at that end of the busbar 5 which is plugged through the window cutout 19 is clearly visible. Furthermore, it can be seen that the bearing limb 8 has an opening or cutout, into which the obliquely positioned, upper free end of the busbar 5 is plugged. In this way, a virtually seamless transition from the bearing limb 8 and the busbar 5 is ensured in order to prevent interlocking of a conductor end which has been inserted into the conductor insertion channel 9 and to ensure that the bearing limb 8 and the obliquely positioned end of the busbar 5 can act as a replacement for a wall of the conductor insertion channel 9.

Figure 4:
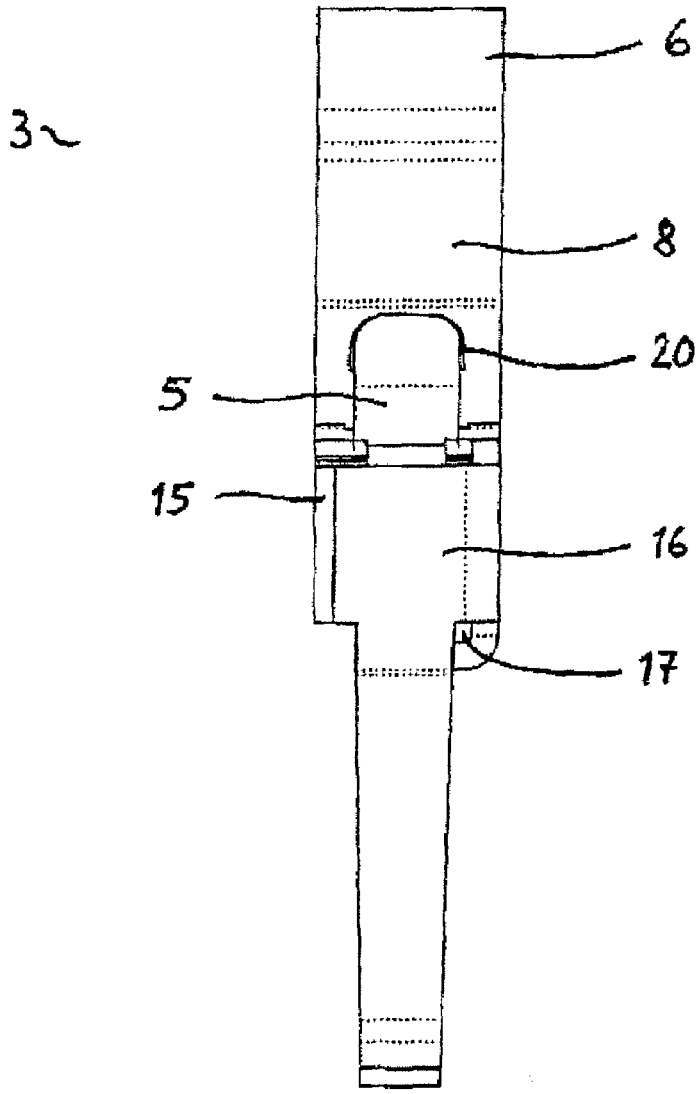
FIG. 4 shows a front view of the clamping spring with the busbar piece from FIG. 2.

FIG. 4 shows a side view of the spring clamping connection 3 from FIGS. 2 and 3. It is shown that the upper free, obliquely positioned end of the busbar 5 has been plugged into a cutout 20 of the bearing limb 8 in order to ensure the seamless transition between the bearing limb 8 and the busbar 5.

Figure 5:
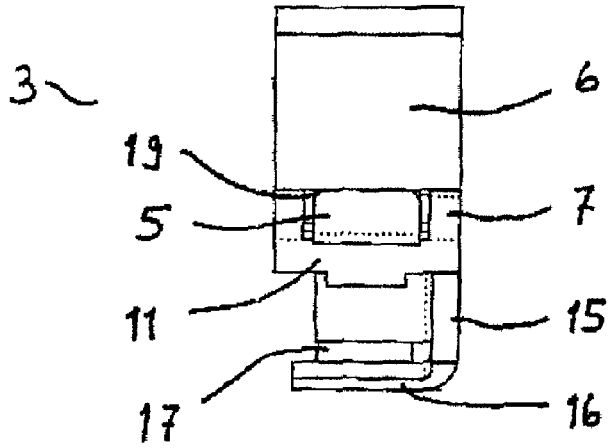
FIG. 5 shows a plan view of the clamping spring with the busbar piece from FIG. 2.

FIG. 5 shows a plan view of the spring clamping connection 3 from FIGS. 2 to 4. It can be seen from this illustration that a relatively narrow end piece 11, which forms the termination of the window cutout 19 and whose free end is tapered, is provided at the end of the bent-back second section of the clamping limb 7. As a result of the small width of the end piece 11, the physical width transversely with respect to the direction of the conductor insertion channel 9 and in the actuating direction of the clamping limb 7 can be further reduced.

Figure 6:
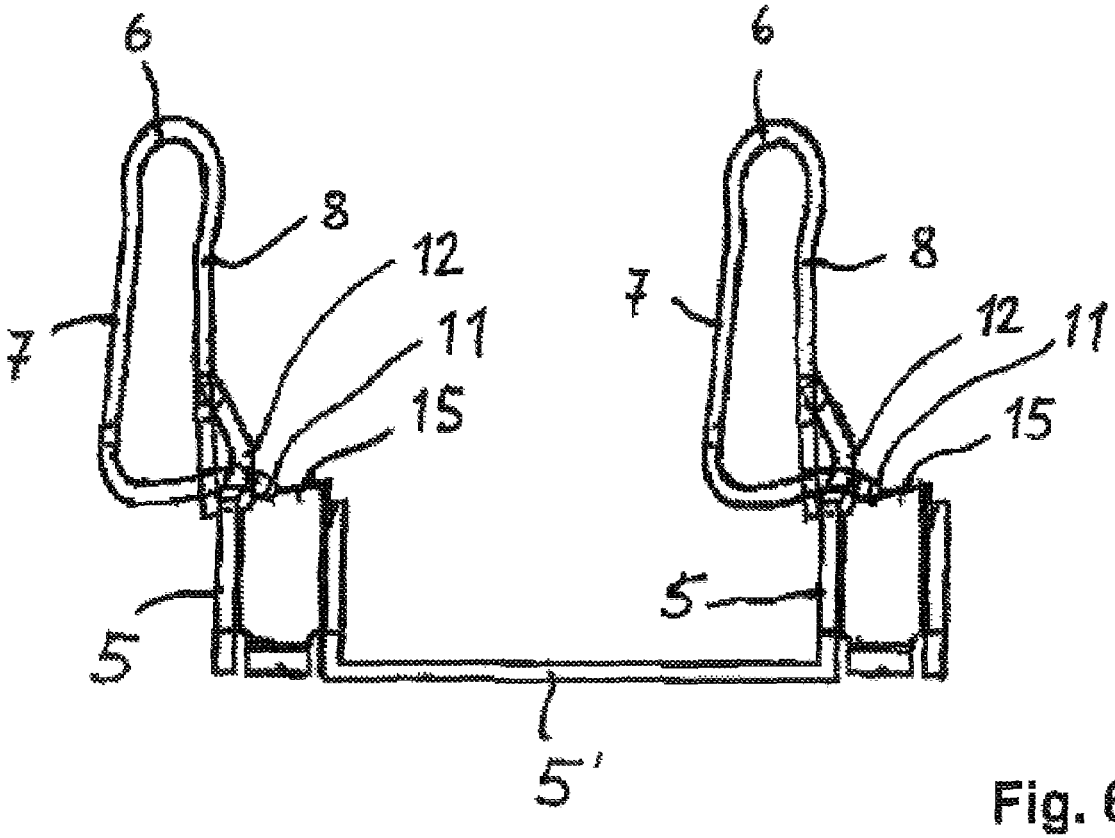
FIG. 6 shows a side view or two clamping springs, as shown in FIG. 3, with a common bus bar connecting the two clamping springs.

FIG. 6 shows an example where more than one clamping points are employed. Specifically, in each case at least two spring-force clamping connections can be connected to one another via a common bus bar 5'.

The invention claimed is:

1. Terminal component (1) with an insulating housing (2) and at least one spring-force clamping connection (3), which has a bent clamping spring (4), formed from sheet spring steel, with bearing limbs (8) and clamping limbs (7), which are connected to one another via a spring bow (6), a busbar (5), which is inserted into the clamping limb (7) and bears against the bearing limb (8), and a conductor insertion channel (9), which is formed in the insulating housing (2) and extends from the spring bow (6) of the clamping spring (4) along the bearing limb (8) wherein the insulating housing (2) forms a wall of the conductor insertion channel (9), said wall being partially interrupted, wherein the busbar (5) has an end bearing against the bearing limb (8), said end of the busbar (5) running obliquely with respect to the bearing limb (8) and forming a funnel of the conductor insertion channel (9), and wherein the bearing limb (8) of the clamping spring (4) together with the busbar (5) forms another wall of the conductor insertion channel (9) in the part of the insulating housing (2) where the wall formed by the insulating housing (2) is partially interrupted.

2. Terminal component (1) according to claim 1, wherein the end of the busbar (5) which bears against the bearing limb (8) is plugged into an opening in the bearing limb (8).

3. Terminal component (1) according to claim 1, wherein ends of the bearing limb (8) and the clamping limb (7) which adjoin the spring bow (6) are spaced apart from one another.

4. Terminal component (1) according to claim 1, wherein the clamping limb (7) has a first section which adjoins the spring bow (6) and extends substantially in a direction parallel to the conductor insertion channel (9), and a second section (10) which extends substantially transversely with respect to the direction of the conductor insertion channel (9), and wherein in the second section, a window cutout (19) is provided through which the end of the busbar (5) which bears against the bearing limb (8) is plugged.

5. Terminal component (1) according to claim 1, wherein the busbar (5) extends substantially in a direction of the conductor insertion channel (9) and has a hump in a region of the clamping limb (7).

6. Terminal component (1) according to claim 5, wherein the busbar (5) has, beneath the clamping limb (7) of the clamping spring (4), an integrally formed connecting plate (15) which protrudes from a side edge of the busbar (5) at right angles, and a connection rail, which adjoins the connecting plate (15) at right angles and is designed to be at least partially mirror-symmetrical with respect to the busbar (5).

7. Terminal component (1) according to claim 6, wherein free ends of the busbar (5) and the connection rail (16) are inclined so as to point toward one another and have connection contact faces (18) so as to form a connection socket.

8. Terminal component (1) according to claim 7, wherein the connection contact faces (18) are in the form of curved humps.

9. Terminal component (1) according to claim 6, wherein the connecting plate has, at an end opposite the clamping limb (7), a stop plate (17) which protrudes at right angles from the connecting plate and extends transversely with respect to the direction of the conductor guide channel (9), such that the busbar (5), the connecting plate (15), the stop plate (17) and the connection rail (16) form a cage for accommodating a conductor end.

10. Terminal component (1) according to claim 1, wherein the insulating housing (2) has, adjacent to the spring bow (6) opposite the conductor insertion opening (9), an actuating opening (13), which is formed at least partially in a side wall of the insulating housing (2), for inserting a screwdriver (14) and pivoting the clamping limb (7) with the inserted screwdriver (14).

11. Terminal component (1) according to claim 10, wherein the actuating opening (13) extends at an angle in the range of from 5 to 30 degrees with respect to the direction of the conductor insertion opening (9).

12. Terminal component (1) according to claim 10, wherein the actuating opening (13) ends beneath a passage of the busbar (5).

13. Terminal component (1) according to claim 1, wherein the clamping limb (7) has, at a free end adjacent to a window cutout (19), through which the free end, which bears against the bearing limb (8), of the busbar (5) is plugged in, an end piece (11), which closes off the window cutout (19).

14. Terminal component (1) according to claim 1 wherein said at least one spring-force clamping connection (3) includes at least two spring-force clamping connections (3) which are each connected to one another via a common busbar (5).

* * * * *